US010212976B2

(12) United States Patent
Bailey

(10) Patent No.: US 10,212,976 B2
(45) **Date of Patent: *Feb. 26, 2019**

(54) GRIPPING AID

(71) Applicant: Claiborne Bailey, Addy, WA (US)

(72) Inventor: Claiborne Bailey, Addy, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/683,720

(22) Filed: Aug. 22, 2017

(65) Prior Publication Data

US 2017/0347727 A1 Dec. 7, 2017

Related U.S. Application Data

(63) Continuation-in-part of application No. 15/412,988, filed on Jan. 23, 2017, which is a continuation of application No. 14/701,311, filed on Apr. 30, 2015, now Pat. No. 9,549,579.

(60) Provisional application No. 61/986,965, filed on May 1, 2014.

(51) Int. Cl.

| | |
|---|---|
| ***A41D 13/08*** | (2006.01) |
| ***A41D 19/015*** | (2006.01) |
| ***A63B 71/14*** | (2006.01) |
| *A63B 60/54* | (2015.01) |

(52) U.S. Cl.

CPC ..... *A41D 19/01564* (2013.01); *A63B 71/143* (2013.01); *A63B 71/146* (2013.01); *A63B 71/148* (2013.01); *A41D 2400/80* (2013.01); *A41D 2600/10* (2013.01); *A41D 2600/20* (2013.01); *A63B 60/54* (2015.10); *A63B 2209/00* (2013.01)

(58) Field of Classification Search

CPC ..... A61B 19/04; A63B 71/148; A63B 71/146; A63B 71/143; A41D 19/02; A41D 13/08; A41D 19/01547

See application file for complete search history.

(56) References Cited

U.S. PATENT DOCUMENTS

| | | | | |
|---|---|---|---|---|
| 1,690,312 | A * | 11/1928 | Rosan | A63B 53/14 473/206 |
| 3,175,226 | A | 3/1965 | Weinberg | |
| 3,413,000 | A | 11/1968 | Alkonis | |
| 3,500,477 | A | 3/1970 | Meszaros | |
| 4,561,122 | A | 12/1985 | Stanley et al. | |

(Continued)

OTHER PUBLICATIONS

Office action for U.S. Appl. No. 14/701,311, dated Jan. 14, 2016, Bailey, "Gripping Glove", 6 pages.

(Continued)

*Primary Examiner* — Tejash Patel
(74) *Attorney, Agent, or Firm* — Lee & Hayes, P.C.

(57) ABSTRACT

This disclosure describes a gripping aid to improve the hand-to-handle interface. The gripping aid increases the grip span of a user by bridging the anatomical gaps in the user's finger and thumb. The gripping aid provide a structure along the thumb web to oppose the gripping force of the fingers/thumb to increase grip strength. In some implementations, the gripping aid may be composed of a crush resistant and further include a fulcrum point to add instability to increase the speed and/or torque of each swing of a handle. In some implementations, the gripping aid may also provide a reduction in vibrations and superficial hand traumas normally caused when the handle strikes an object.

20 Claims, 16 Drawing Sheets

(56) References Cited

U.S. PATENT DOCUMENTS

| | | | | |
|---|---|---|---|---|
| 5,168,578 | A | 12/1992 | Stanley | |
| 5,180,165 | A * | 1/1993 | Frost | A63B 60/10 2/20 |
| 5,257,418 | A | 11/1993 | Jaskiewicz | |
| 5,345,609 | A | 9/1994 | Fabry et al. | |
| 5,604,934 | A | 2/1997 | Willett | |
| 5,770,297 | A | 6/1998 | Grubich | |
| 5,790,980 | A | 8/1998 | Yewer, Jr. | |
| 5,806,091 | A | 9/1998 | McHugh | |
| 5,987,642 | A | 11/1999 | Webster | |
| 6,260,198 | B1 | 7/2001 | LoMedico | |
| 6,427,246 | B1 | 8/2002 | Doi et al. | |
| 6,721,960 | B1 | 4/2004 | Levesque et al. | |
| 6,732,374 | B1 | 5/2004 | Blair | |
| 7,895,669 | B2 | 3/2011 | Kleinert | |
| 7,963,864 | B2 | 6/2011 | Frost | |
| 8,852,033 | B1 | 10/2014 | Frost | |
| 9,549,579 | B2 * | 1/2017 | Bailey | A63B 71/146 |
| 2005/0121927 | A1 | 6/2005 | Gazaui | |
| 2006/0163890 | A1 | 7/2006 | Namiki | |
| 2006/0195968 | A1 | 9/2006 | Powell et al. | |
| 2011/0265239 | A1 | 11/2011 | Kanemitsu et al. | |
| 2015/0313298 | A1 | 11/2015 | Bailey | |
| 2017/0127739 | A1 | 5/2017 | Bailey | |

OTHER PUBLICATIONS

Office action for U.S. Appl. No. 15/412,988, dated Feb. 23, 2017, Bailey, "Gripping Glove", 4 pages.
Search Report and Written Opinion dated Nov. 2, 2017, for PCT Application No. PCT/US17/48224, 8 pages.

* cited by examiner

GRIPPING AID

CROSS REFERENCE TO RELATED APPLICATION

This application is a continuation-in-part of and claims priority to U.S. patent application Ser. No. 15/412,988, entitled "Gripping Glove," filed Jan. 23, 2017 which claimed priority to U.S. patent application Ser. No. 14/701,311, entitled "Gripping Glove," filed Apr. 30, 2015, which claims priority under 35 U.S.C § 119 to U.S. Provisional Patent Application. No. 61/986,965 filed May 1, 2014, entitled "Improved Gripping Glove," each of which are incorporated by reference in its entirety herein.

BACKGROUND

A human hand has a complex anatomy composed of five digits (four digits and an opposable thumb) having twenty-seven bones (fourteen phalanges (proximal, middle or intermediate, and distal), five metacarpals, and eight carpals), joints, ligaments/tendons, muscles, arches (longitudinal, transverse, and oblique), soft tissue, skin folds/webs, nerves, and vascular anatomy.

Furthermore, the human hand includes an anterior surface (palm) and posterior surface (dorsal) that are shaped by the arches of the hand to create a hollow cavity which changes shape during hand movements. For instance, the shape of the hollow cavity created by the hand arches changes shape with the hand grasps an object and my change differently based on the size of the object grasped.

Hand anatomy allows for manipulation of a multitude of different objects but this also makes it susceptible to musculoskeletal diseases, nerve disorders, vibration, bone bruises, blisters, fatigue, and/or other discomfort because of the lack of opposition in the skin folds/webs, natural gaps created at the joints and skin creases between the hand and the grasped object. This is particularly true when a user must grip and manipulate a tool with a handle (e.g., ax, hammer, shovel, baseball/softball bat, lacrosse stick, rowing oar, or the like). In these instances, the user must exert maximum gripping effort with their hand(s) to maintain control the tool because of the lack of support within the thumb web area of the hand, potential limitations of the handle design to optimize grip span, and the rotational forces and push/pull forces required to properly manipulate the tool. However, the repetitive maximum gripping effort and natural oscillation of the handle within the hand may result in various injuries to the hand such as musculoskeletal injuries, carpal tunnel syndrome, blisters and/or bruises caused by repetitive force, impact, and vibrations transferred to the hand when the tool contacts an object (tree, nail, ball, or the like). Furthermore, the generally round shape of tool handles does not provide an ideal shape and/or size (e.g., diameter, circumference) for maximizing a relaxed grip while allowing maximum tool control and accounting for rotational forces, grip span and/or user comfort. In addition, the human hand does not have the needed support because the hand shape and anatomy (e.g., incompressibility) naturally lacks an oppositional force to maximize the rotational movement that round handle shapes required to provide the ideal leverage point needed for maximizing the efficiency, control, power, speed, and/or strength of a user manipulating the tool.

One solution that others have attempted is to create a gripping aid which reduces the hand-to-handle friction in order to reduce the movement of the handle within the hand.

However, these attempts ignore the anatomy of the human hand and the natural movement (e.g., oscillation) needed to efficiently manipulate of a handle.

In another solution others have attempted is to apply ergonomic grip science directly to the handle or tool to update the handle design in an attempt to increase comfort and usability. However, these attempts to alter the handle design are deficient since: 1) they cannot account for the specific anatomy (e.g., palm or finger size, high or low hand arches, an amount of soft hand tissue, grip span length, etc.) of the user's hand and therefore, lack user customization; 2) render the tool less functional since the handle design requires that the tool be manipulated in a specific manner; and 3) do not reduce vibration, bone bruises, and skin abrasions, etc.

As such, there remains a need for a comfortable gripping aid that utilizes grip arch performance technology with dual arch design to provide ergonomic grip span customization to a user's hand and orthotic support for biomechanical enhancement. Furthermore, there remain a need for a gripping aid that provides a combination of stability and instability (e.g., by promoting the natural oscillation of the hand-to-handle interface and increasing friction of the handle within the hand) which is more reflective of the natural hand movement and creates grip efficiency. Such a gripping aid also minimizes potential damage to a user's hand(s) by reducing vibrations, bone bruises, blisters and fatigue, while simultaneously providing a fulcrum to maximize the efficiency, control, power, speed, and/or hand strength as the user manipulates the tool.

BRIEF SUMMARY OF INVENTION

This disclosure generally relates to a gripping aid for the human hand which may be worn to improve a user's grip on an item. In some implementations, this disclosure describes a gripping aid as it relates to a swingable tool with a rigid handle (i.e., cylindrical, elliptic cylinder, polyhedral cylinder with n-gonal sides, or the like) such as a hammer, ax, shovel, baseball bat, softball bat, golf club, oar, paddle, or the like.

Furthermore, this disclosure relates to a gripping aid which may act as a shaped support along at least a portion of the thumb webbing that bridges the soft tissue of the thumb web and adds support to the metacarpophalangeal joints of the index and thumb, that may enhance biomechanical functions and capabilities of the user's hand while gripping.

In some implementations, the gripping aid may be integrated with the glove to form a continuous piece of material from a joint on a first digit (e.g., thumb) of a hand to a joint on a second digit (e.g., index finger) of the hand. In some implementation, the gripping aid may be integrated with a glove along a portion of the thumb web. In other implementations, the gripping aid may be integrated with a glove along a portion of the thumb web and at least one of the digit.

In some implementations, the gripping aid may act as a shaped support which may be a crush resistant or incompressible compound such as silicon rubber, ethylene propylene rubber, polyether ether ketone (PEEK) other, thermoplastic polyolefins (polypropylene, polyethylene, and copolymer combinations of them); polyethylene foams (e.g., Plastazote™, Nickelplast); open-cell polyurethane foam (Poron™); ethylene vinyl acetate (EVA); closed-cell neoprene foam (Spenco™); thermoset carbon-fiber composites; (e.g., continuous-fiber thermoplastic); and others, such as natural and artificial cork, or the like. In some implementations, the gripping aid and shaped support may be composed of a compressible material or a combination of incompressible and compressible materials.

In some implementations, the shaped support may provide an improved hand-to-handle interface by creating a buffer zone to help position the tool away from a portion of the hand and fills or bridges the natural gaps formed by the soft tissue of the fingers when the joints are flexed to grip a handle. In addition, the shaped support of the gripping aid may be customizable to the size and shape of the user's hand to provide specific support to the arches of the user's hand, create an oppositional grip area in the soft tissue area of the thumb web.

This disclosure describes that the shaped support of the gripping aid may include a fulcrum point (e.g., a curved radius point or sharp point) facing away for the user's hand and toward the handle held by the human hand. The fulcrum point may be the primary location of the hand-to-handle interface and act as a location for rotation between the hand and handle. When the user manipulates the handle, the fulcrum point may act to increase the friction at the hand-to-handle interface and increase the natural oscillation of the handle within the hand as it is manipulated.

Furthermore, this disclosure describes a gripping aid that places the hand in the optimal gripping position and with an optimal grip span, which may enhance grip strength. For instance, the gripping aid may position the hand such that it is slightly slanted away from the handle and the handle is not in contact with the hand in the rest position. This may increase the oscillation of the handle in the hand when the user manipulates the handle. As mentioned above, in some implementations, this disclosure describes the fulcrum point of the gripping aid may act as a point of rotation to allow the hand to more efficiently and effectively manipulate the tool as it is manipulated. For instance, the fulcrum point (such as a variable radius curve) may speed the centripetal force of a distal end of tool as the user grips and manipulates a proximal end of the tool. In some implementations, the shape of the gripping aid may increase momentum or torque of the tool as it is manipulated and thus lower the moment of inertia without reducing the power created by the manipulation. In this instance, the gripping aid may help maximize the efficiency and/or speed of each movement of the tool. As such, the gripping aid described herein may increase output forces upon the tool, enhance comfort, reduce grip tension, reduce vibration, and reduce overall fatigue of a user swinging the tool. In other implementations, the gripping aid described herein may be used independently of other aids or as an integral part of other gripping aids, for example, gloves.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items or features.

DETAILED DESCRIPTION

Figure 1:
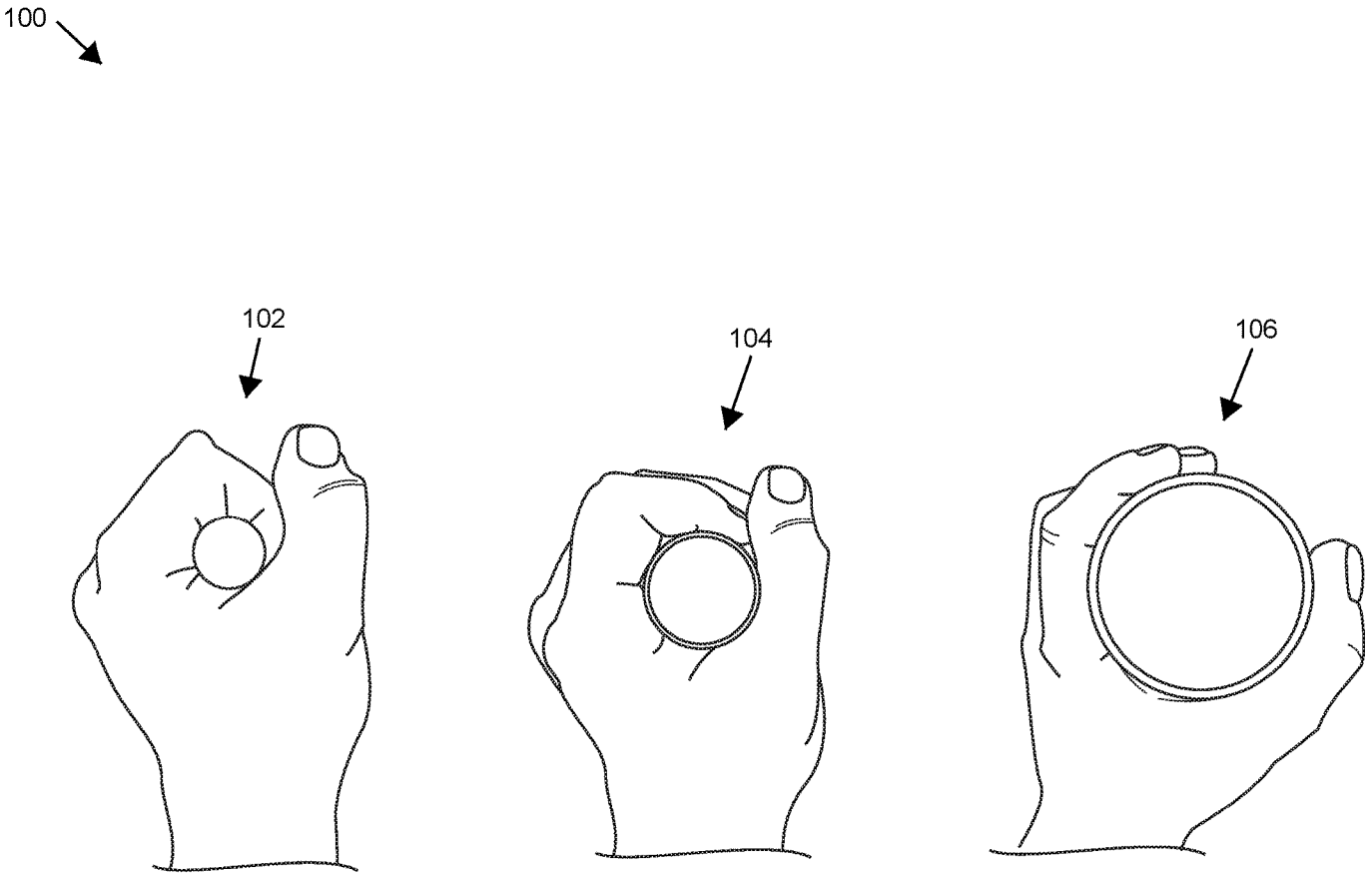
FIG. 1 is a view of a human hand gripping handles of various sizes.

This disclosure describes embodiments of a gripping aid or support for providing maximum grip control, force, torque, acceleration, rotation, and/or leverage by creating an improved hand-to-handle interface which bridges the natural gaps formed by the soft tissue of the fingers when the joints are flexed to grip a handle, provides customizable support based on the specific anatomy of the user's hand(s), and/or creates an oppositional grip area in the soft tissue area of the thumb web. Furthermore, the gripping aid may further reduce incidences of bruises and/or superficial skin trauma (e.g., abrasions and/or blisters) caused by the rotational forces associated with a swing and/or reduce vibrations caused when the tool strikes an object.

In some implementations, the gripping aid may be incorporated within a portion of a glove. For instance, the gripping aid may be a single shaped support that extends continuously between the distal interphalangeal (DIP) joint or the proximal interphalangeal (PIP) joint of the index finger and the interphalangeal (IP) joint of the thumb along the thumb webbing/thenar webbing which is the "skin web" that extends between the thumb and index finger. In some implementations, the gripping aid may be more specifically offset toward the lateral aspect of the area between a joint on the index finger and a joint on the thumb. In this implementation, each joint of the index finger and each joint of the thumb may be permitted to flex without significant impediment from the gripping aid.

In some implementations, the gripping aid may be incorporated with multiple portions of a glove. For instance, the gripping aid may include multiple shaped supports along a portion of any set of a user's finger and thumb webbing as described above. That is, the gripping aid may also be located from the DIP joint to the metacarpophalangeal joint of the index finger, middle finger, ring finger, and/or pinky finger.

The gripping aid may be formed or molded from a single material or multiple materials (i.e., formed with multiple layers). In some implementations, the gripping aid may be formed of a combination of compressible materials and/or incompressible materials. For instance, the gripping aid may include a vibration dampening, flexible material such as silicon rubber, ethylene propylene rubber, polyether ether ketone (PEEK), thermoplastic polyolefins (polypropylene, polyethylene, and copolymer combinations of them); polyethylene foams (e.g., Plastazote™, Nickelplast); open-cell polyurethane foam (Poron™); ethylene vinyl acetate (EVA); closed-cell neoprene foam (Spenco™); thermoset carbon-fiber composites; (e.g., continuous-fiber thermoplastic); and others, such as natural and artificial cork, or the like.

In some implementations, the hardness of the gripping aid may be from about 10 to about 90 using a Shore A durometer. In some implementations, the hardness may be from Shore 00 0 to about Shore D 100. In some implementations, the hardness may be from Shore 00 0 to about Shore D 100. In some implementations, the gripping aid may be resistant to crushing deformation such that the overall thickness of the gripping aid may be maintained even when a user is securely gripping the handle and applying a squeezing force to the gripping aid. As described fully below, the gripping aid may fill the gap between the handle and the hand other of the (i.e., the finger joints gaps and thumb webbing) and provide support for an oppositional force of the user's fingers along at least a portion of the thumb webbing.

In some implementations, the gripping aid may be pre-contoured to fit the thumb webbing of a user's hand and/or include a hinge or joint (e.g., parametric kerf pattern, living hinge, lattice hinge, zipper joint, or rib joint) to maximize the flexibility of the gripping aid. Furthermore, the thickness and/or shape of the gripping aid may vary. For instance, the thickness of the gripping aid may taper as the gripping aid approaches a joint of the index finger and/or thumb. In some implementations, a side of the gripping aid toward a user may include a contoured or concaved surface to better conform to the finger(s), thumb, and thumb webbing of the user.

In other implementations, the gripping aid may include more than one shaped support attached to each other. For instance, in one implementation, a first, more soft or supple, support may be located between the user's hand(s) and attached to a second, more resilient support configured to interface with the handle. In other implementations, a gripping aid may include more than one shaped support for placement at more than one location of the palmar side of the hand. In these implementations, the hardness of the multiple gripping aids may be in a range of about 0 as measured using a Shore 00 durometer to about 100 using a Shore D durometer.

A thickness of the gripping aid may position the hand in the optimal gripping span for optimal gripping strength. In some implementations, the shape of the gripping aid may also concentrate gripping pressure about and along a top surface of the gripping aid while the gripping aid's resistance to crushing causes a fulcrum point (i.e., a variable radius curve across the width of the shaped support) of the gripping aid to function as a pivot about which the handle of the tool rotates during movement. Therefore, the fulcrum point of the gripping aid faces toward and may contact the handle when the gripping aid is wrapped around the handle.

The oppositional force created by the gripping aid toward the gripping fingers and the concentrated gripping pressure may lead to decreased user hand fatigue, increased comfort, and increased control for the specific task using the handled tool. Furthermore, the specific placement of the gripping aid may allow unrestricted motion of the fingers and hand joints by keeping the support away from the center axis of rotation for each specific joint, thereby creating momentum.

In some implementations, the gripping aid may have different sizes and shapes while maintaining the fulcrum point (e.g., variable radius curve) and thicknesses, depending on the size of the user's hand and/or the application of the tool. For instance, the thickness of the gripping aid may be about 1 millimeter to about 42 millimeters. In some implementations, the thickness of the gripping aid may be at least 0.5 millimeter. In some implementations, the thickness of the gripping aid may be from about 6 millimeters to about from 12 millimeters. In other implementations, the thickness of the gripping aid may be from about 0.5 millimeters to about from 5 millimeters. In other implementations, the thickness of the gripping aid may be from about 25.5 millimeters to about from 42 millimeters.

In some implementations, the gripping aid may be integrated with a glove and constructed in any number of sizes to fit the hands (left and/or right) of various users. For instance, a smaller glove with a smaller gripping aid may be constructed for use by a younger user with a smaller hand(s). Conversely, a larger glove with a larger gripping aid spanning an area to substantially cover the thumb webbing of a larger hand(s) may be constructed for an older user.

The term "about" or "approximate" as used in context of describing example gripping aid is to be construed to include a reasonable margin of error that would be acceptable and/or known in the art.

As used herein, the terms "a," "an," and "the" mean one or more.

As used herein, the terms "comprising," "comprises," and "comprise" are open-ended transition terms used to transition from a subject recited before the term to one or more elements recited after the term, where the element or elements listed after the transition term are not necessarily the only elements that make up the subject.

As used herein, the terms "having," "has," "contain," "including," "includes," "include," and "have" have the same open-ended meaning as "comprising," "comprises," and "comprise" provided above.

The present description may use numerical ranges to quantify certain parameters relating to the invention. It should be understood that when numerical ranges are provided, such ranges are to be construed as providing literal support for claim limitations that only recite the lower value of the range as well as claim limitations that only recite the upper value of the range. For example, a disclosed numerical range of 1 to 10 provides literal support for a claim reciting "greater than 1" (with no upper bounds) and a claim reciting "less than 10" (with no lower bounds) and provides literal support for and includes the end points of 1 and 10.

This overview is provided to introduce a selection of concepts in a simplified form that are further described below. The overview is provided for the reader's convenience and is not intended to limit the scope of the claims, nor the proceeding sections.

Example Grip Anatomy and Gripping Aid

FIG. 1 illustrates a views of a human gripping handles of various sizes. Each hand in FIG. 1 shows a "power grip" such that the handle is held against the palm of the hand, the long flexor tendons pull each finger and the thumb so that they can tightly close around the handle. Generally, the "power grip" is made possible by the four fingers flexing and the ability of the thumb to be positioned opposite the fingers. Therefore, the intrinsic muscle of the hand (e.g., intrinsic thenar and hypothenar muscle groups) provide the strength and torque of the "power grip." However, the push/pull action of these intrinsic muscle of the hand cause the soft tissue that forms the thumb web area to compress. Therefore, the strength of the "power grip" is typically proportional to the range of flexion in the interphalangeal (IP) joints of the fingers since these joints must compensate for the lack of compressed thumb web area.

FIG. 1 illustrates the shape of the human hand as a user grips a rounded handle. For instance, 102 shows a human hand gripping a handle with a generally smaller diameter. Generally, since the handle has a smaller diameter, the flex or bend required by the IP joints of the fingers is high. Thus, the "power grip" is relatively weaker than a "power grip" with a larger handle diameter. As described below, the gripping aid disclosed herein may be positioned along the thumb web area to reduce the amount of flex of the IP joint of the finger, thus strengthening the grip.

At 104, FIG. 1 illustrates a human hand as it grips a handle with a medium diameter which is a more typical scenario and handle size. In this example, the flex of the interphalangeal joint of the fingers is not as pronounced as the "power grip" for the smaller handle. However, the flex of the IP joints may create a gap between the hand-to-handle interface. In other words, the bending of each IP joint may cause the soft tissue of each finger proximal to each IP joint to fold or crease. The areas where this soft tissue is caused to fold does not become a point of the hand-to-handle interface. As described with reference to the figures below, the gripping aid may fill or bridge the gap caused by the folded soft tissue at each of or selected one of the IP joints to increase the grip span of the "power grip."

At 106, FIG. 1 illustrates a human hand as it grips a handle with a larger diameter. While the flex at each IP joint of the fingers is less compared to 102 and 104, the hand-to-handle interface lacks the necessary instability to more efficiently manipulate the handle. In other words, the hand-to-handle interface in the palm area is too great which results in excess contact between the hand and handle. In this instance, the hand-to-handle interface lack friction and the ability to create oscillation as the hand manipulates the handle. As described below, the gripping aid of this disclosure include a shaped support faced away from the user's hand and toward the handle. The shaped support may form a point such as a variable radius curve from a first side of the gipping aid to a second side of the gripping aid. The point may provide a fulcrum for the hand-to handle interface as the handle is manipulated by the hand. Thus, the fulcrum point of the shaped support increases the friction at the hand-to-handle interface, introduces instability in the hand-to-handle interface, reintroduces a natural gap between the handle and the palm, and allows for the oscillation of the handle as it is manipulated.

Figure 2:
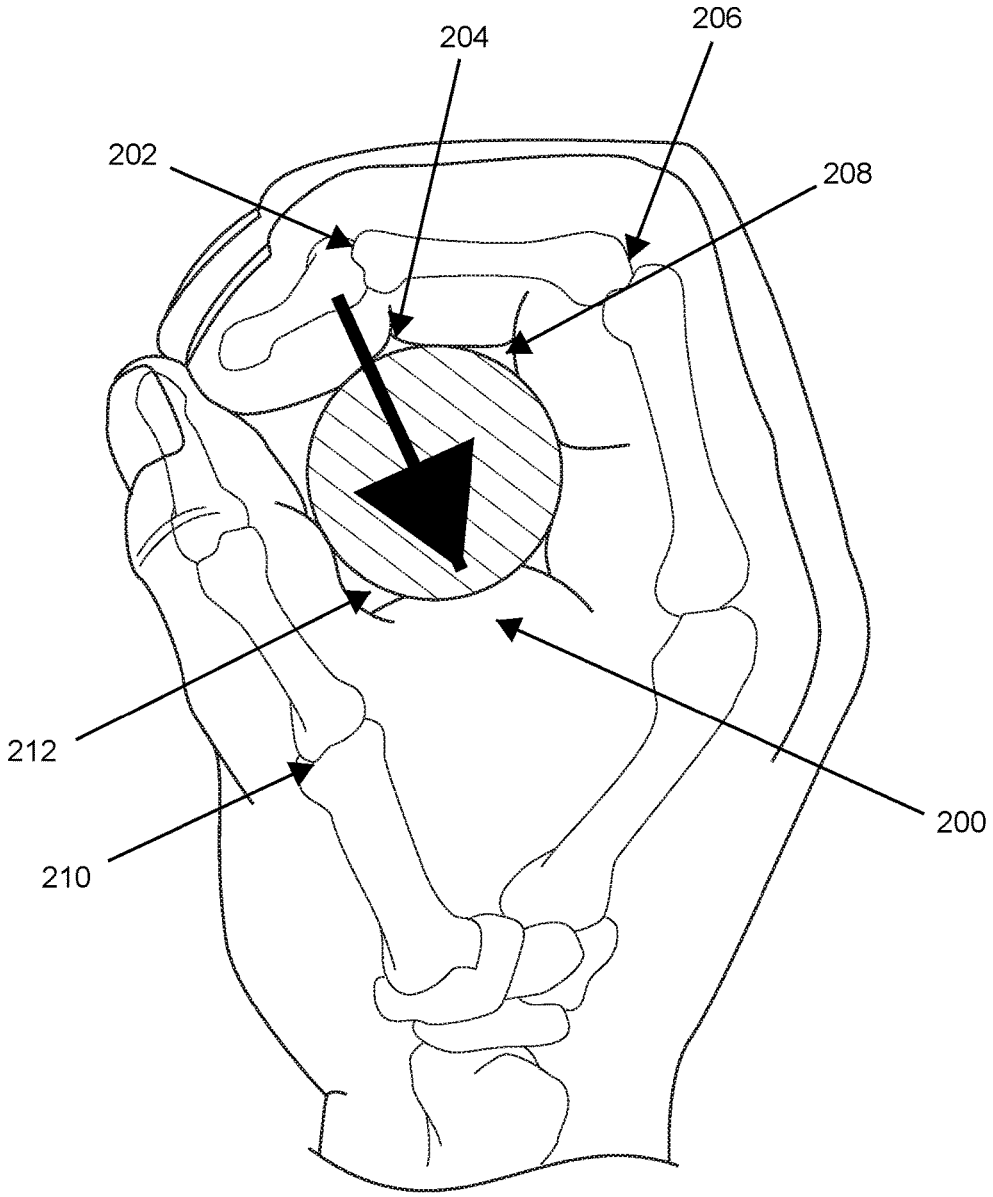
FIG. 2 is a view of the anatomy of a human hand gripping a medium size handle.

FIG. 2 illustrates the anatomy of the human hand including the soft tissue, joints and bone as the hand applies pressure in order to grip a round handle. As indicated by the direction of the large arrow, the force of the grip is generated by the muscle of the finger and thumbs towards the soft tissue area 202. However, since the soft tissue area 202 does not anatomically include any rigid structure such as bone, there may be a lack of an oppositional force in this soft tissue area 202. In many instances, this may lead to fatigue and/or injury.

FIG. 2 further illustrates that the flex of the IP joints may lead to the creation of folds in the soft tissue along the fingers and thumb which result in various gaps in the hand-to-handle interface. For instance, FIG. 2 shows the flexion of the distal IP joint 204 of the index finger may cause the first gap 206 in the hand-to-handle interface while the flexion of the middle IP joint 208 of the index finger may cause the second gap 210 in the hand-to-handle interface. In some implementation, the flexion of the metacarpophalangeal joint 212 of the thumb may cause a third gap 214 in the hand-to-handle interface. FIG. 2 illustrates an example number of gaps between the hand-to-handle interface caused by the folds in the soft tissue of the fingers and thumb. However, other locations of soft tissue folds may be present to cause gaps in the hand-to-handle interface. For instance, a fourth gap may be caused by the flexion of the proximal IP joint of the index finger to disrupt the hand-to handle interface. In addition, while FIG. 2 illustrated the index finger and thumb, it should be understood that similar creases and gaps are present on the remaining fingers when the hand grips a round handle.

Figure 3:
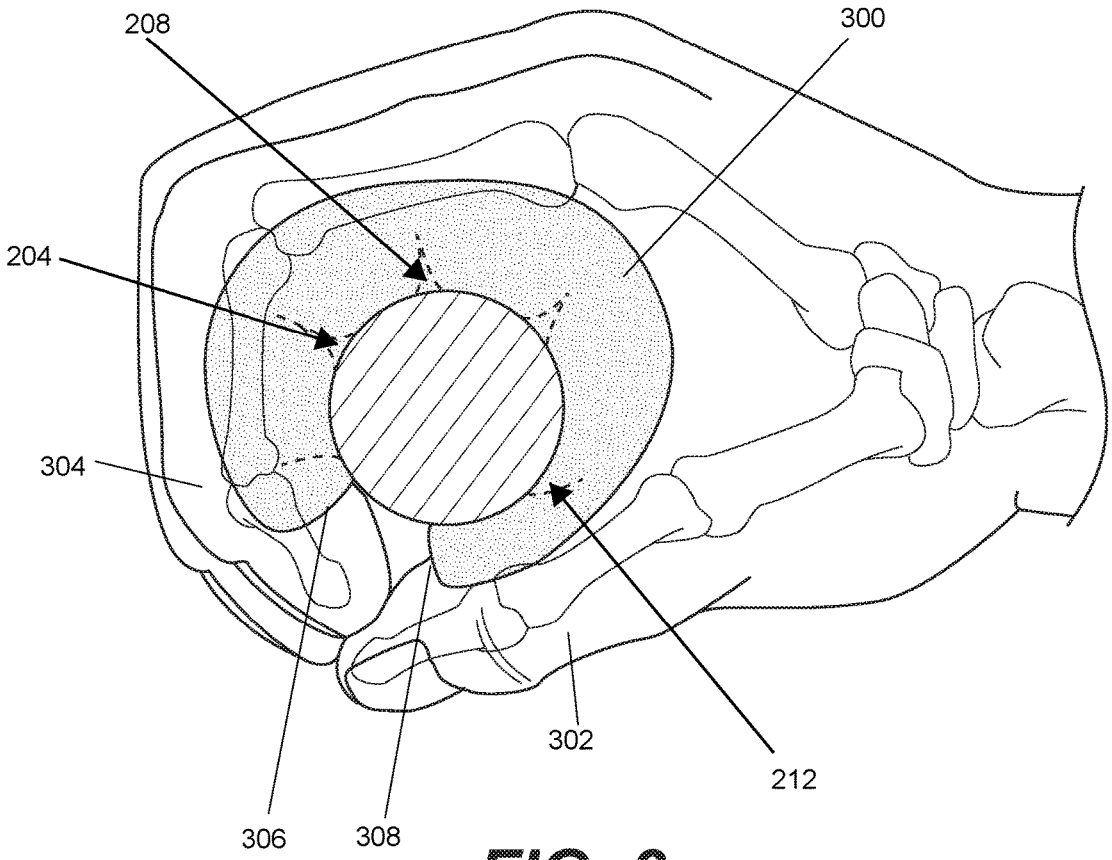
FIG. 3 is a view of the anatomy of a human hand gripping a medium size handle with a gripping aid.

FIG. 3 illustrates an example gripping aid 300 placed on a right hand of a human to fill the gaps 206, 210, and 214 described in reference to FIG. 2. However, in other embodiments, the gripping aid 300 (or any other gripping aid or glove described herein) may be configured to be placed on a left hand of a human.

FIG. 3 illustrates that a gripping aid 300 may be placed along the thumb webbing along the thumb 302 and index finger 304. As shown, the gripping aid 300 may form a continuous support along the thumb webbing from a first end 306 beginning on the index finger 304 near the distal interphalangeal (DIP) joint to the second end 308 on the thumb near the interphalangeal (IP) joint of the thumb. In other implementations, the first end 306 may begin at the proximal interphalangeal (PIP) joint of the index finger 304.

As mentioned above, gripping aid 300 may increase the grip span of the hand-to-handle interface by filling the gaps created by the soft tissue fold areas and the flexed finger/thumb joints. In other words, the gripping aid 300 provides a continuous hand-to-handle interface from near the DIP joint of the index finger to near the IP joint of the thumb.

In some implementations, the gripping aid 300 may have a greater width at the soft tissue area 200. Furthermore, the incompressibility of the material composing the gripping aid 300 may provide an oppositional support for the force exerted by the fingers and thumb toward the soft tissue area 200 as the user squeezes the handle. As such, the gripping aid 300 may increase the grip strength of the user.

Figure 4:
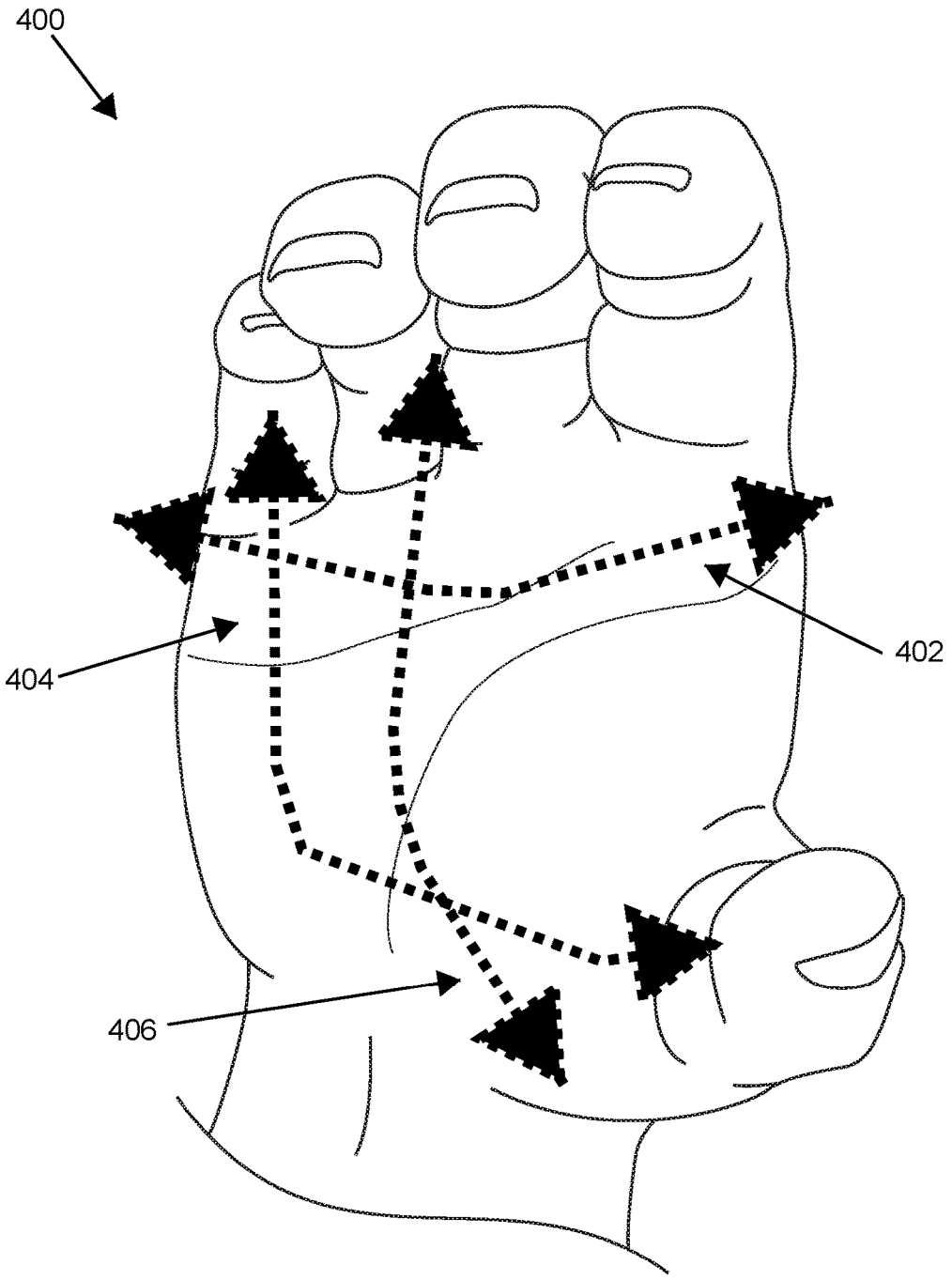
FIG. 4 is a view of the palm side of a human hand showing the hand arches.

FIG. 4 illustrates the palm side 400 of a right hand of a human showing three arrow representing the three arches of a human hand which help the hand grasp and conform to objects of different sizes and shapes, direct the precise movement of the fingers, and help control the power of a grip. The arrows 402 represents the distal transverse arch. The arrows 404 represents the oblique arch. Finally, arrows 406 represents the longitudinal arch.

Generally, the hand arches 402, 404, and 406 work together to maximize the amount of surface contact with a gripped object which typically enhances the stability of the gripped object and sensory input received by the nerves of the hand.

In many instances, the curve of the longitudinal arch (arrow 406) increases when the hand grips a handle by flexing the fingers/thumb around the handle. In some implementations, the gripping aid 300 exploits the increased curvature of the longitudinal arch when the hand grips a handle to create instability. For instance, the shape of the gripping aid includes a fulcrum point (apex, or a variable radius curve) that acts as a fulcrum that substantially runs the grip span along the longer axis of the gripping aid. In other words, when the user manipulates the handle, the gripped portion of the handle rotates over the fulcrum point of the gripping aid creating torque as the handle oscillates between the first side of the fulcrum point and the increased curvature of longitudinal arch of the palm. In effect, the gripping support creates a greater rotational distance between the increased longitudinal arch portion of the palm and the fulcrum point which results in increased centripetal force at the distal portion of the handle. In addition, this may result in an increase in power transfer to an object being struck without requiring the user to significantly alter his/her grip strength, grip position, and/or swing speed.

Figure 5:
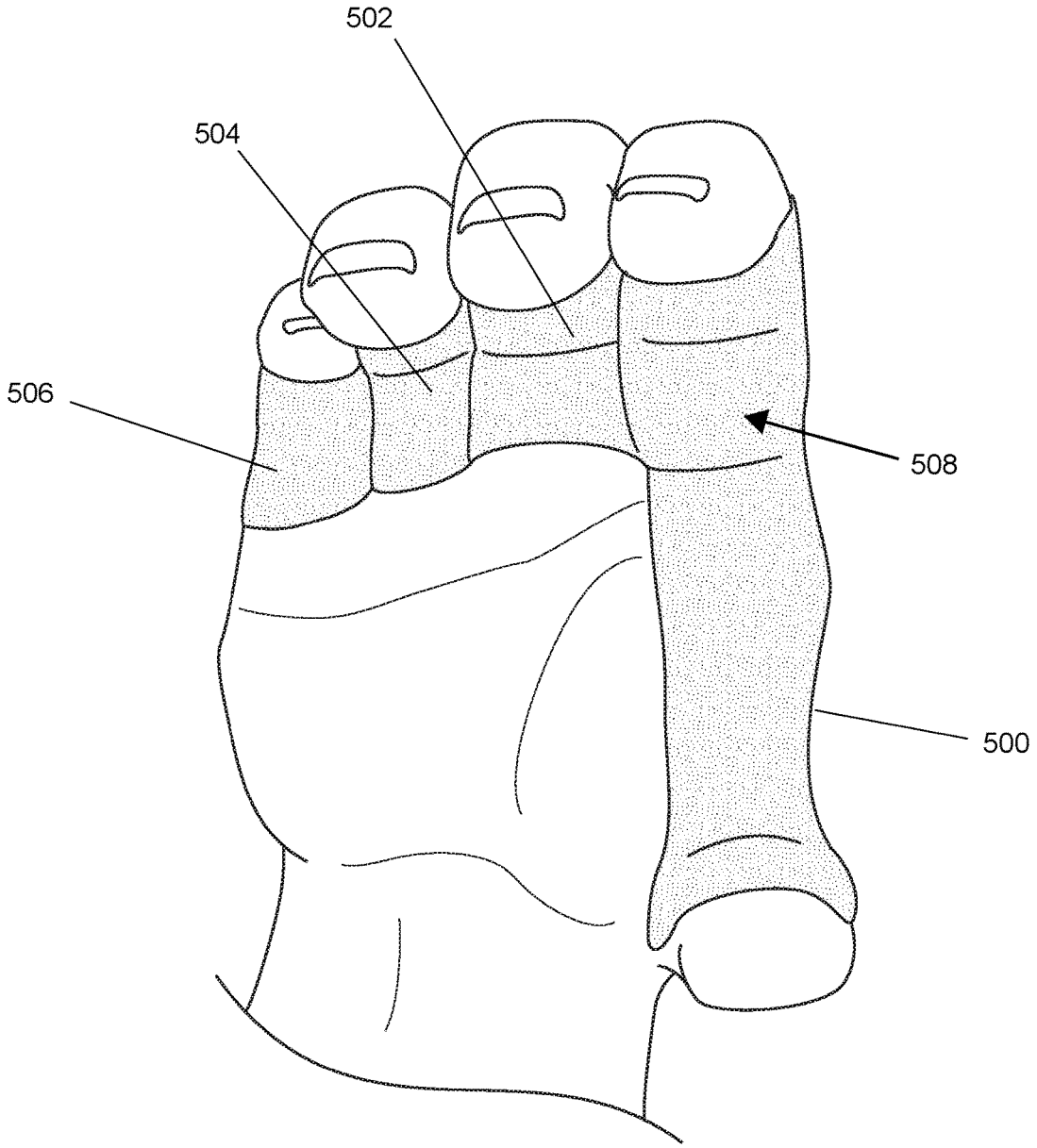
FIG. 5 is a view of the palm side of a human hand including a gripping aid on each finger and thumb.

FIG. 5 illustrates an example gripping aid 500 which substantially covers the thumb web along the thumb and index finger and a portion of the middle finger, ring finger, and little finger. In some instances, the gripping aid 500 may be formed of a single piece of material. In some implementation, the gripping aid 500 may be formed of incompressible materials such as those described above. However, in some implementations, the gripping aid 500 may be configured to bend along creases, for example, to accommodate the flexion of the middle IP joint of the user's fingers. In some implementations, the thumb web portion, the middle finger portion 502, the ring finger portion 504, and the little finger portions of the gripping aid 500 may include a bond or otherwise be attached substantially all the way along the sides of the respective portions. In other implementations, each finger portion of the gripping aid 500 may only be attached toward the finger webbing portion of the gripping aid 500 to allow for finger mobility.

The gripping aid 500 include the fulcrum point, in this instance, a variable radius curve 508. The curvature of the variable radius curve 508 of the gripping aid begins on the lateral side of each finger on the gripping aid 500 and travels toward the medial side of each finger on the gripping aid 500. In some implementations, the apex of the variable radius curve runs the entire portion of each finger portion of the gripping aid 500 facing away from the hand. In some implementations, the variable radius curve is identical on each finger of the gripping aid 500. However, in other implementations, the variable radius curve may vary (e.g., be a steeper curve or lesser curve) between the multiple fingers of the gripping aid 500.

Figure 6:
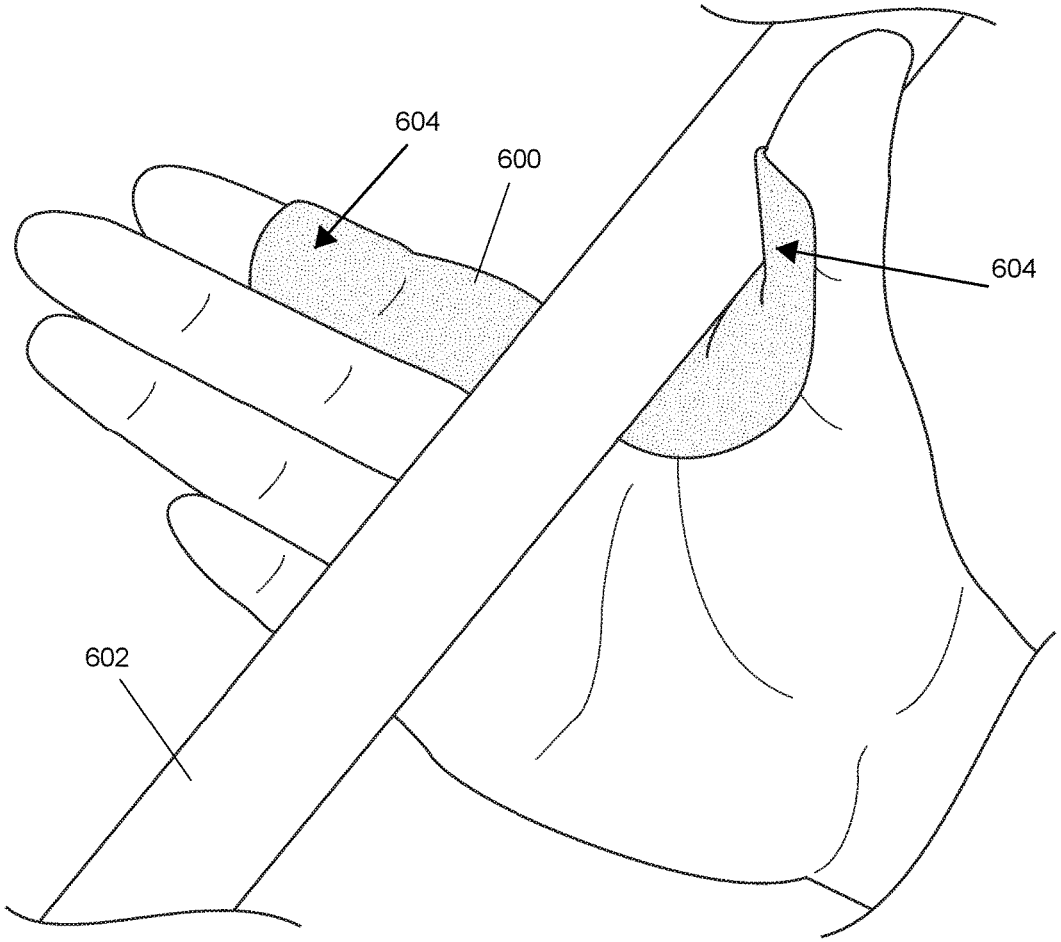
FIG. 6 is a first perspective view of an example gripping aid.

FIG. 6 illustrates an example gripping aid 600 which may be placed directly against the skin of a user's hand (i.e., without a glove). In some implementations, the gripping aid 600 may include a removable and/or reusable adhesive layer to help the gripping aid 600 remain in contact with the user's hand. While FIG. 6 illustrates the gripping aid 600 positioned along the thumb webbing between the index finger and the thumb, it is to be understood that the gripping aid may be placed between any other joint on other fingers.

FIG. 6 shows the gripping aid 600 which may be offset toward the lateral aspect of the thumb webbing between a joint on the index finger and a joint on the thumb. For instance, the gripping aid 600 may be affixed to the hand from about 30 degrees to about 60 degrees from a medial surface of the index finger toward the lateral surface of the index finger. In other implementations, the gripping aid may be equidistance from the medial surface of the index finger toward the lateral surface of the index finger.

Figure 7:
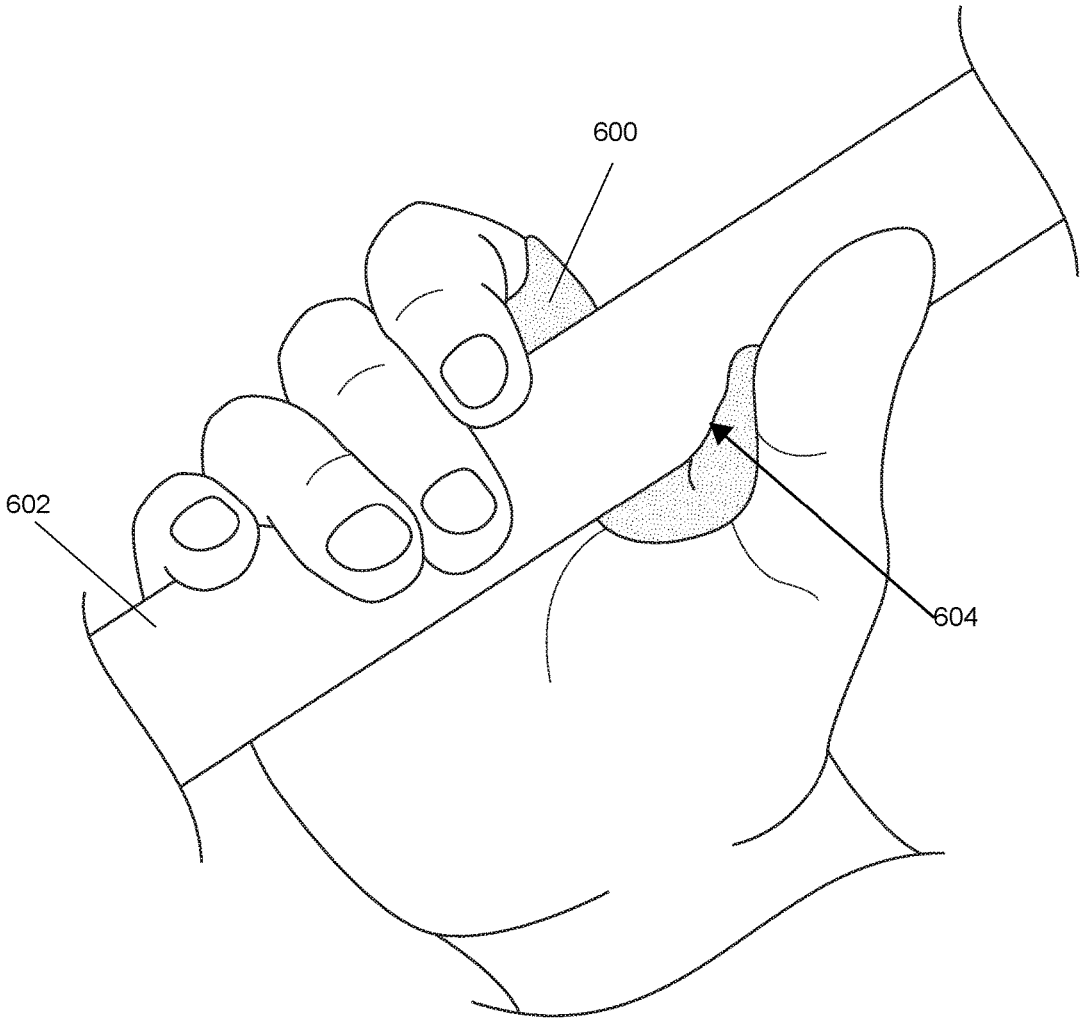
FIG. 7 is a second perspective view of an example gripping aid.

In some implementations, the lateral offset may reduce an amount of restriction of flexibility of each joint adjacent to the gripping aid when, for example, the index finger is curled toward the palm of the hand around the handle 602 as shown in FIG. 7. In addition, the lateral offset may position a fulcrum point 604 (which is shown running a substantial portion of the apex of the gripping aid 600) in a position to maximize a speed of a handled tool as it is swung by a user wearing the gripping aid 600.

The lateral offset of the fulcrum point 604 gripping aid 600 as shown in FIG. 6 may also increase the grip span of a user wearing gripping aid 600 since the gripping aid substantially covers the soft tissue gaps of the index finger and thumb as described above with regard to FIG. 3. Stated otherwise, the thickness of the gripping aid extending toward the lateral aspect may increase the gripping surface of the user's hand which may allow the hand of the user to cover more surface of the gripping handle 602. One skilled in the art is generally aware of the positive correlation between an increase in grip span and an increase in grip strength. Thus, the gripping aid 600 which increases the grip span of one or more user's hand may increase the user's grip strength without altering the user's existing grip and/or requiring a tighter grip.

Figure 8:
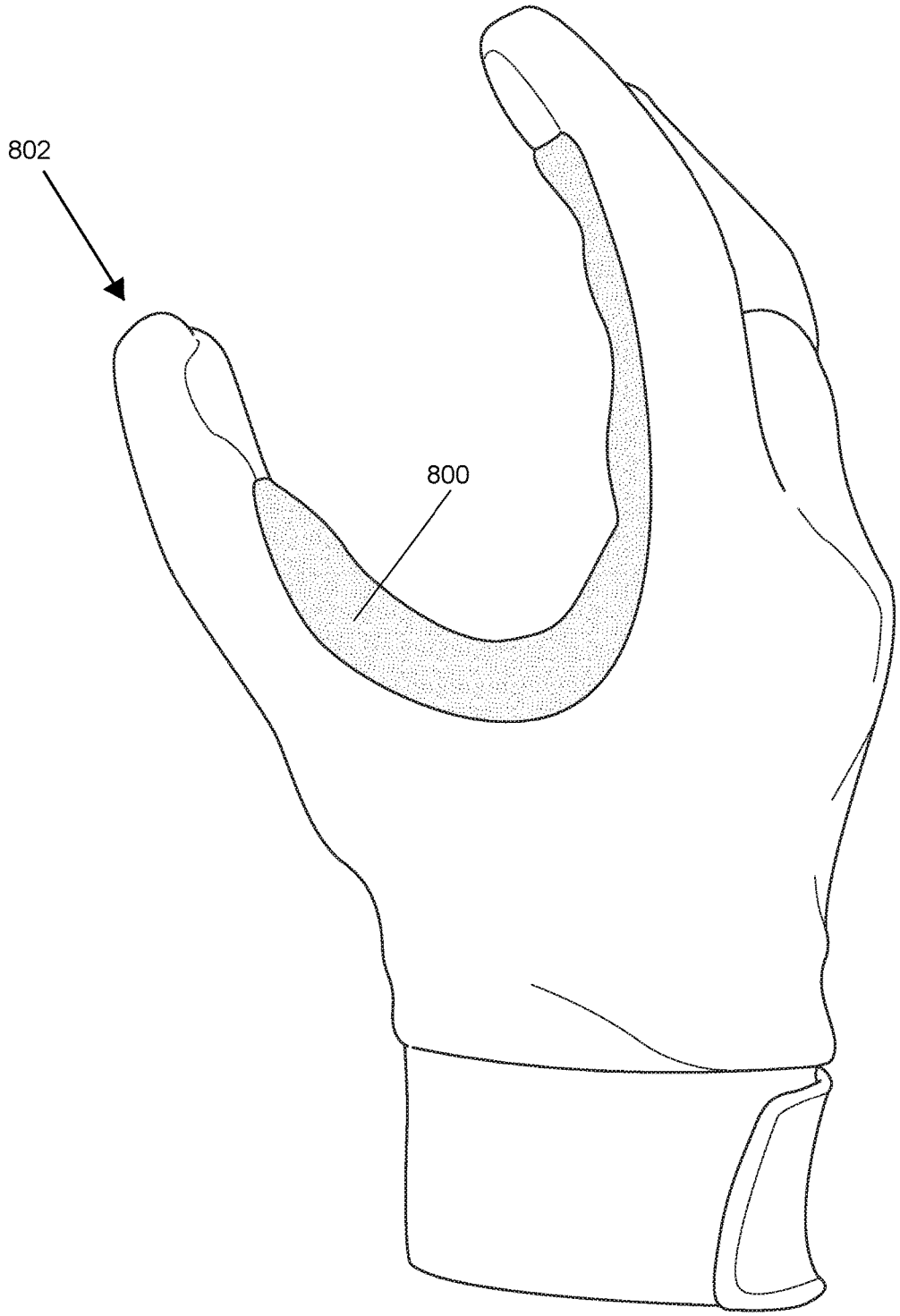
FIG. 8 is a perspective view of an example gripping aid with a glove.

As shown in FIG. 8, an example gripping aid 800 may be secured to the glove 802 by placing one or more pieces of fabric over the gripping aid 202. In some implementations, the gripping aid 800 may attached directly to the glove 802. In these implementations, gripping aid 800 may be glued, sewn, or otherwise bonded directly to the glove 802. In other implementation, the gripping aid 800 may be integrated within the interior of glove 802. For instance, the gripping aid 800 may be covered by a fabric. The fabric may be leather, synthetic leather, or any other natural or synthetic material. In some implementations, the glove 802 may be designed with extra room in the palm region to allow space for the gripping aid worn directly on the palm of a user.

As shown in FIG. 8, the gripping aid 800 may include a non-slip texture to reduce the potential slippage of the handle in the user hand. In addition, the non-slip texture may further increase the friction between the hand-to-handle interface. Thus, increasing grip efficiency.

Figure 9:
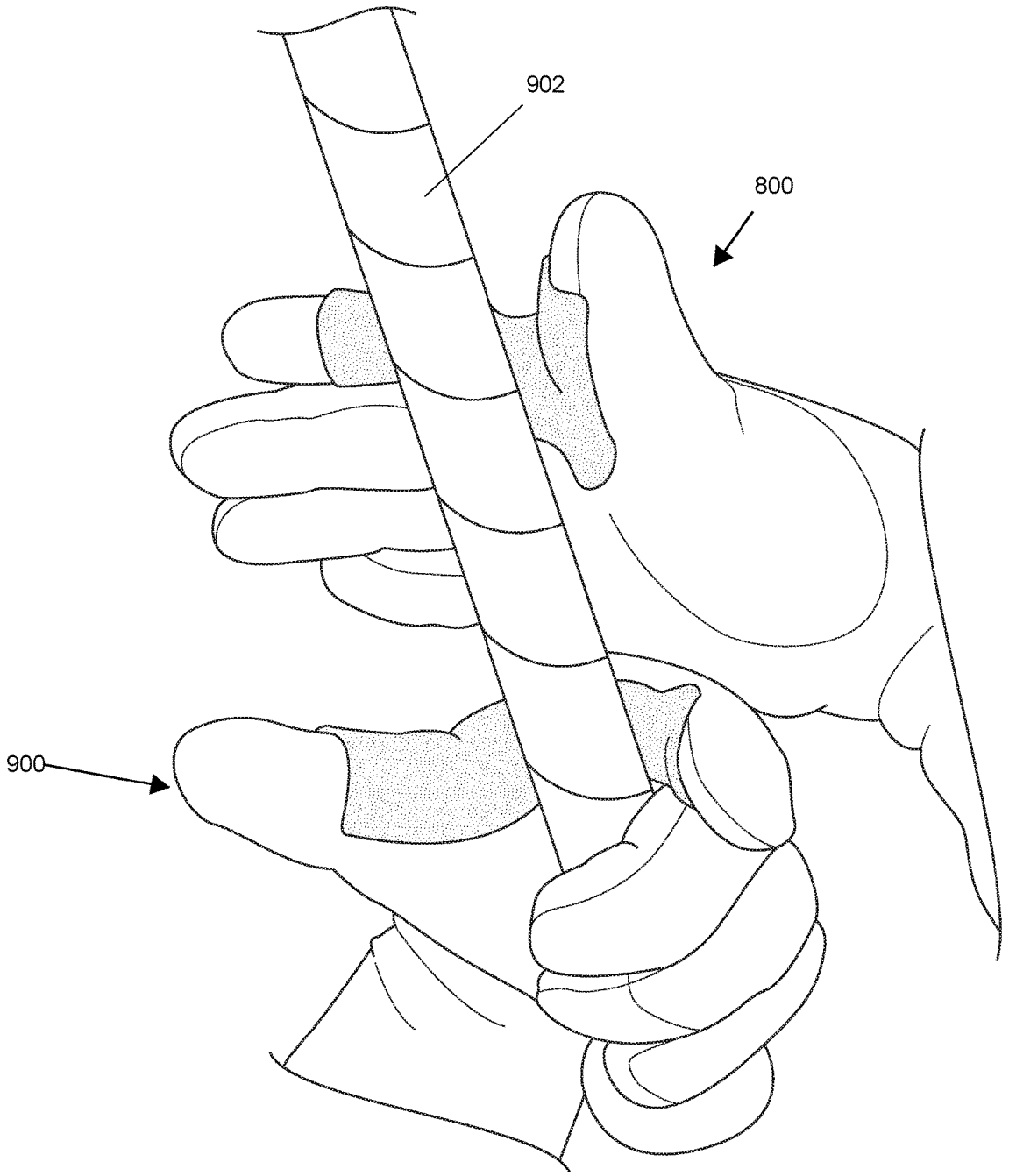
FIG. 9 is a perspective view of an example gripping aid in two gloves.

FIG. 9 illustrates right-handed glove 800 as described above in addition to a left-handed glove 900 (collectively hereinafter, "gloves"). As shown, the gloves are in the initial stages of gripping a handle of a tool, in this instance, a handle portion of a baseball bat 902. The handle portion of the baseball bat 902 (or any other handled tool) is configured to abut or rest in the thumb webbing of each hand wearing the gloves. Next, in some implementations, each finger of the glove would wrap around the handle portion of the baseball bat 902.

The gripping aids integrated with the gloves may be configured to bend when the user wraps each finger around the handle portion of the baseball bat 902. In some implementations, the gripping aids in the gloves may be constructed of a flexible, yet incompressible, material such as silicone rubber, ethylene propylene rubber, or other elastomers. The gripping aids may be a constructed to a thickness from about 1 millimeter to 25.5 millimeters such that each gripping aid remains pliable along the gripping aid's longer axis while resisting crushing or deformation along the gripping aid's shorter axis. In other implementations, the thickness of the gripping aids may be from about 25.5 millimeters to about 46 millimeters.

In some implementations, the gripping aid may be jointed and/or hinged to help the gripping aid flex along the longer axis. For instance, the gripping aid may include a parametric kerf pattern, a living hinge, a lattice hinge, a zipper joint, a rib joint, or a combination thereof. In some implementations, the gripping aid may be pre-contour before the gripping aid and customized to the size of the user's hand and/or glove. For instance, the gripping aid may be molded or formed to fit the thumb webbing from a joint on the index finger to a joint on the thumb along of a particular size hand at a resting position. In other implementations, the gripping aid may be unmolded to contour to a user's hand or may be molded to contour to other positions of the user's hand (e.g., molded to fit a particular handle diameter as it would be gripped by a user's hands).

Figure 10:
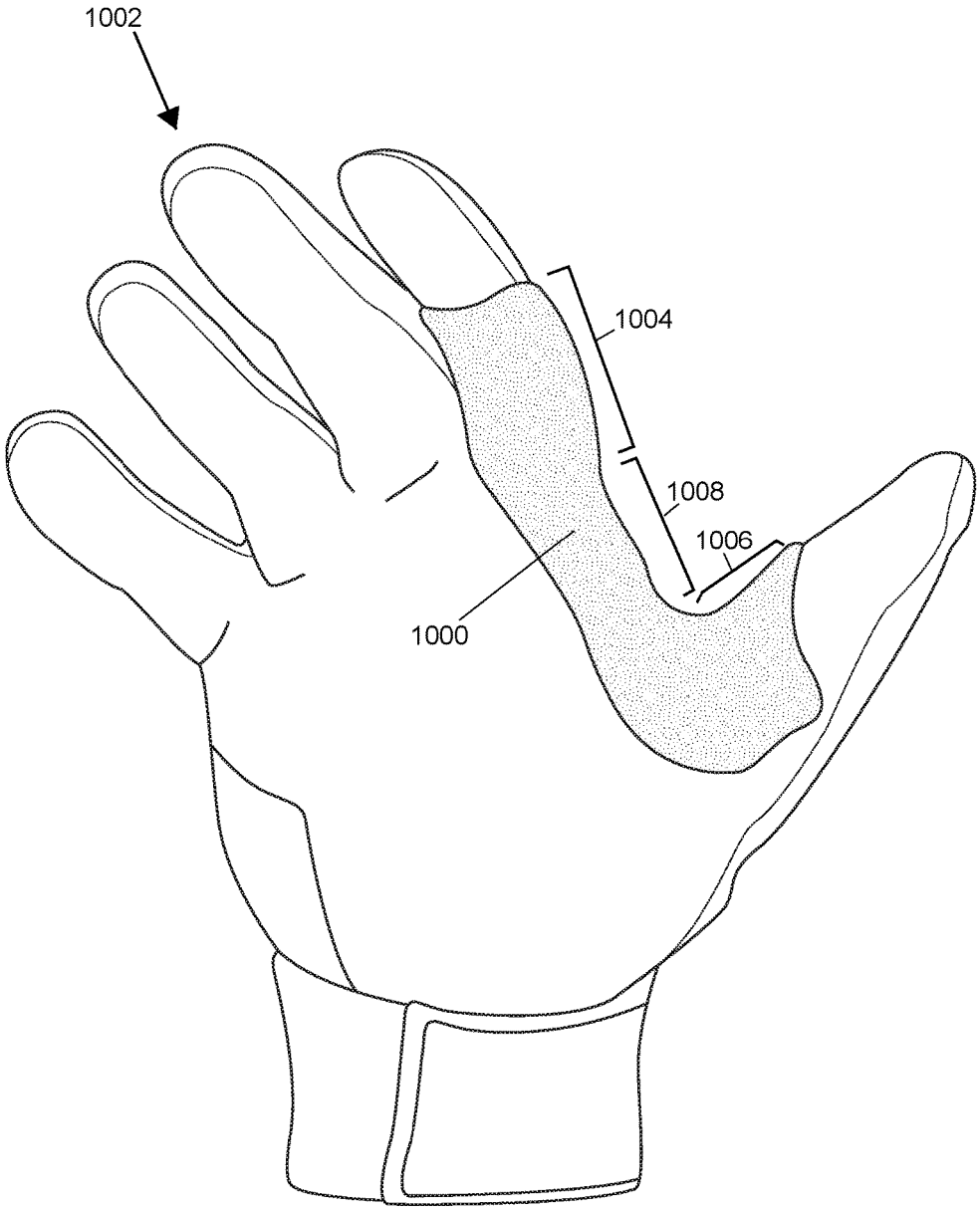
FIG. 10 is a perspective view of an example gripping aid positioned along the thumb webbing in a glove.

FIG. 10 illustrates an example perspective view of a gripping aid 1000 which may be integrated with a glove 1002 as described above. In some implementations, gripping aid 1000 may be integrated on an exterior portion of a glove 1002. However, in other implementations, gripping aid may be integrated on an interior portion of the glove proximate to the glove wearer's skin. As described above, gripping aid 1000 may be composed of a slip-resistant and/or texture, flexible elastomer such as silicone rubber, ethylene propylene rubber, for example. Furthermore, the gripping aid 1000 may be configured to conform to a surface of a user's hand. As shown in FIG. 10, a first portion 1004 may be configured to substantially cover a surface of a user's hand between the distal interphalangeal (DIP) joint and the metacarpophalangeal (MCP) joint of the index finger. While a second portion 1006 may be configured to cover to a surface of a user's hand between the interphalangeal (IP) joint and the metacarpophalangeal (MCP) joint of the thumb. Finally, in the implementation shown in FIG. 10, a third portion 1008 may be configured to substantially cover the thumb webbing while the user wears the glove with the gripping aid 1000.

Gripping aid 1000 may be flexible such that when the user places the glove 1002 on his/her hand, the gripping aid 1000 generally conforms to the contour of the user's hand. Furthermore, the flexibility of the gripping aid 1000 may permit a first end on the index finger and a second end of the thumb to curve towards one another as the user grips the handle of a tool.

In some implementations, the thickness of gripping aid 1000 may be uniform between the first portion 1004, second portion 1006, and third portion 1008. However, in other implementations, the thickness of the gripping aid 1000 may be less at the first portion 1004 and the second portion 1006. In this implementation, the thickness of the gripping aid 1000 may gradually increase from each end toward the third portion 1008 covering the thumb webbing.

As shown in FIG. 10, the gripping aid 1000 may be configured to contour to the portion of the user's hand. For instance, the gripping aid 1000 may include a concave surface configured to curve around a portion of the user index finger, thumb, and/or thumb webbing. In some implementations, the gripping aid 100 may have a uniform width from the first portion 1004 to the second portion 1006. However, in other implementations as shown below, the gripping aid may have a width that varies.

Figure 11:
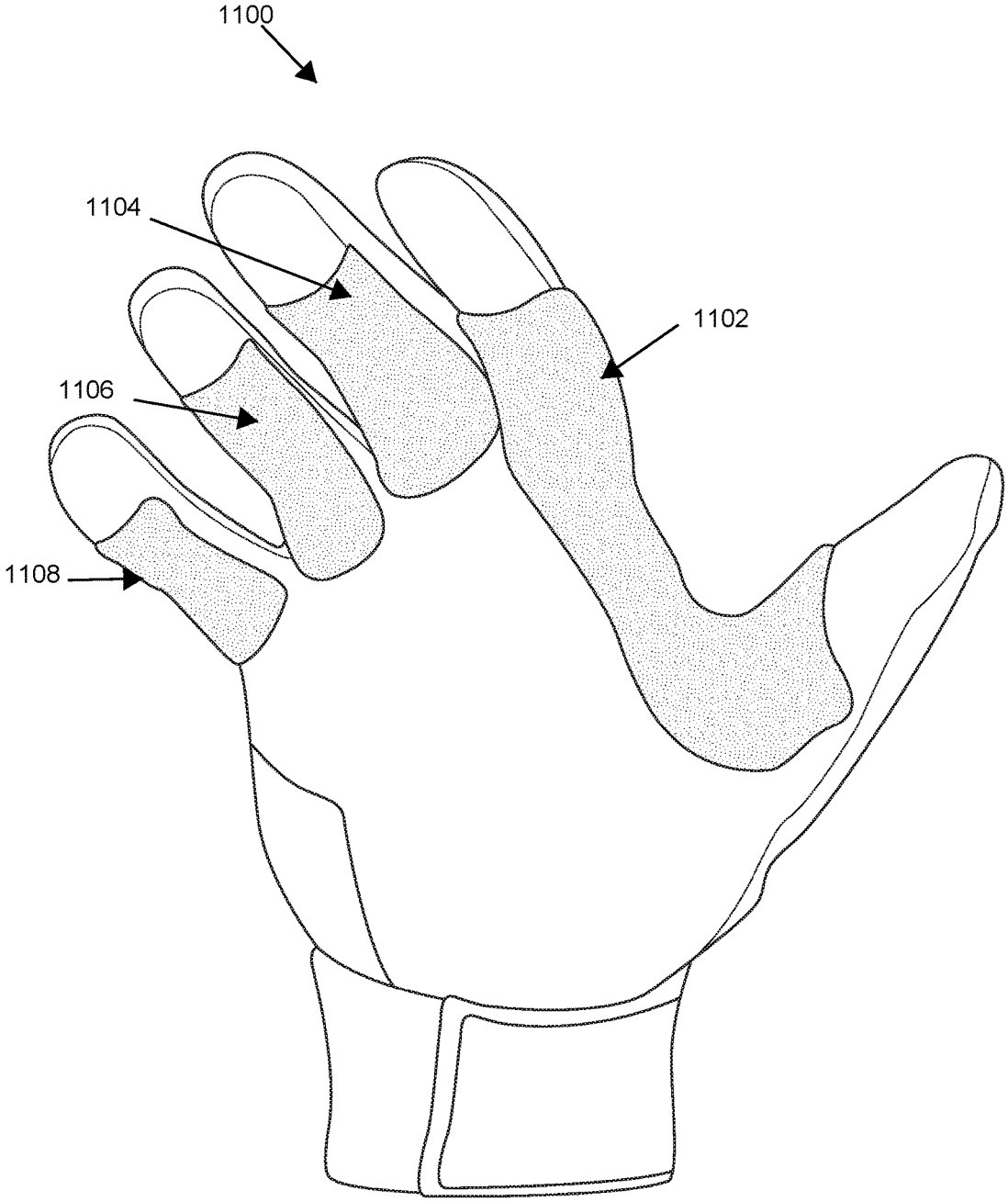
FIG. 11 is a perspective view of example gripping aids positioned along each finger and thumb of a glove.

FIG. 11 illustrates an example glove 1100 with a gripping aid integrated with each finger and thumb. For instance, glove 1100 may include a first gripping aid 1102 similar to gripping aid 1000 described above. In addition, glove 1100 may include a second gripping aid 1104 along a portion of the middle finger, a third gripping aid 1106 along a portion of the ring finger, and a fourth gripping aid 1108 along a portion of the little finger. Each gripping aid may separately integrated with the corresponding finger portion of the glove 1100 without being attached to another gripping aid.

In some implementations, the first gripping aid 1102 may include a thickness of 0.5 mm to 25.5 mm and a width of 0.5 mm to 30 mm with a preformed shape ranging from neutral position to about 0 degrees to about 65 degrees flexion at the metacarpal phalangeal joint of the thumb and 75 degrees flexion at interphalangeal joint of the index finger.

In some implementations, the second gripping aid 1104 may include a thickness of 0.5 mm to 25.5 mm or from about 0.5 mm to about 10 mm and a width of 0.5 mm to 30 mm, with a shape ranging from neutral position or from about 0 degrees to about 70 degrees flexion at the metacarpal phalangeal joint, 0 degrees to 120 degrees flexion at the proximal interphalangeal joint and 0 degrees to 140 degrees flexion at the distal interphalangeal joint.

In some implementations, the third gripping aid 1106 may include a thickness of 0.5 mm to 25.5 mm or from about 0.5 mm to about 10 mm and a width of 0.5 mm to 30 mm, with a preformed shape or contour ranging from neutral position or 0 degrees to 65 degrees flexion at the metacarpal phalangeal joint, 0 degrees to 130 degrees flexion at the proximal interphalangeal joint and 0 degrees to 160 degrees flexion at the distal interphalangeal joint.

In some implementations, the fourth gripping aid 1108 may include a thickness of 0.5 mm to 25.5 mm or from about 0.5 mm to 10 mm and a width of 0.5 mm to 30 mm, with a preformed shape ranging from neutral position or 0 degrees to 65 degrees flexion at the metacarpal phalangeal joint, 0 degrees to 135 degrees flexion at the proximal interphalangeal joint and 0 degrees to 125 degrees flexion at the distal interphalangeal joint.

Each of the gripping aids shown in FIG. 11 may include a fulcrum point as described above. In some implementations, each gripping aid of glove 1100 may have a fulcrum point of a differing variety and/or degree. For instance, the radius of each fulcrum point may decrease from the first gripping aid 1102 towards the fourth gripping aid 1108.

Figure 12:
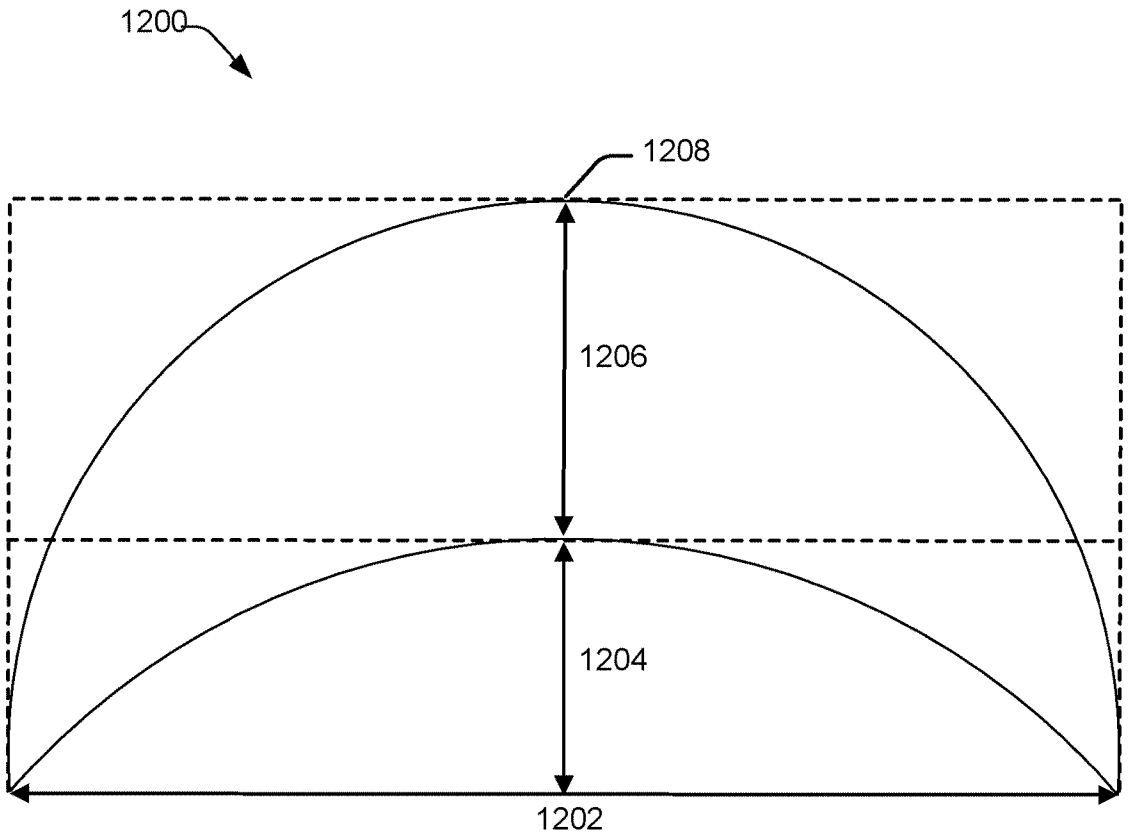
FIG. 12 is a cross-sectional view of the example gripping aid.

FIG. 12 illustrates a cross sectional view of an example gripping aid 1200. In this implementation, the gripping aid 1200 has a symmetrical shape with a width 1202 that is equal distance from a centerline of the gripping aid 1200. As shown, the gripping aid 1200 may include a concave surface with a depth shown at 1204. As described above, the concave surface may allow for the gripping aid 1200 to securely conform to the various parts of the user's hand.

FIG. 12 further illustrates the thickness of the gripping aid 1200 may be thickest at an area indicated by 1206. FIG. 12 also illustrates fulcrum point 1208 such the variable radius curve which faces away from the human hand and toward the handle when held in the hand. As described herein, a variable radius curve may represent a curve of the gripping aid that spans the width of the gripping aid.

Figure 15:
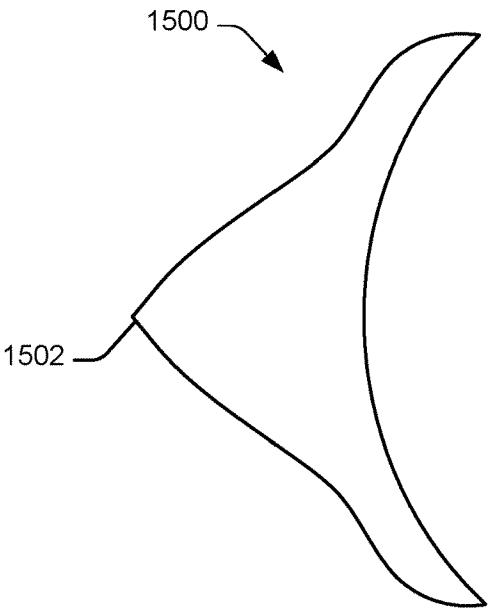
FIGS. 13-15 are cross-sectional or profile views of example gripping aid with different fulcrum points.
Figure 14:
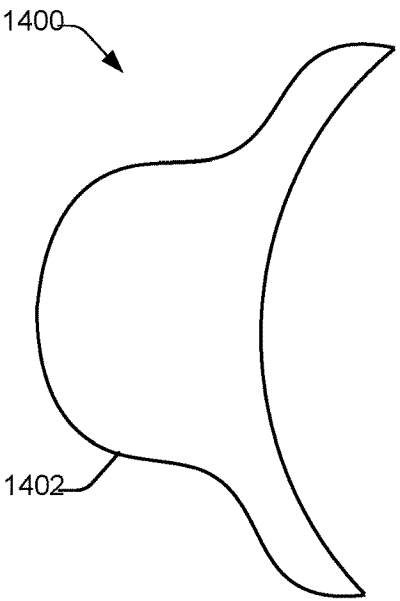
Figure 13:
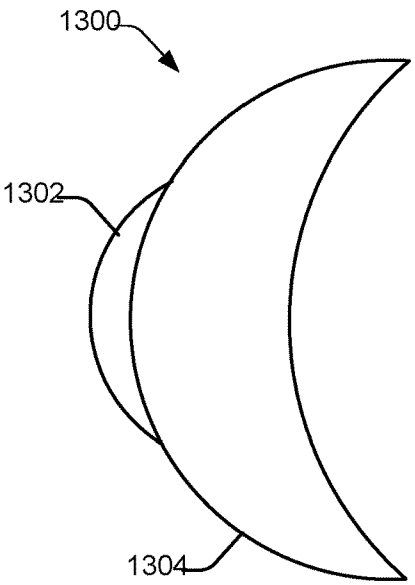

FIGS. 13-15 illustrate alternative example profile shapes of a gripping aid. FIG. 13 shows a profile shape of a gripping aid 1300. Gripping aid 1300 may be composed of two separate pieces. For instance, a first domed piece 1302 to provide the fulcrum point as described in the implementations above. In addition, gripping aid 1300 may include a second piece 1304 which may be positioned between the first piece 1302 and a portion of the user's hand. In some implementations, the first piece 1302 and the second piece 1304 may be composed of the same material. However, in other implementations, each piece may be composed of a different material. For instance, the first piece 1302 may be composed of a hard plastic, incompressible material while the second piece 1304 may be composed of a softer, flexible, vibration-dampening plastic as described above. In some implementations, the first piece 1302 and the second piece 1304 may be attached to one another by conventional methods (e.g., adhesives, glue, heat bonding, etc.).

FIG. 14 illustrates another example profile shape of an implementation of a gripping aid 1400 with an enhanced fulcrum point 1402. As shown, the fulcrum point 1402 is more prominently elevated from the body of the gripping aid 1400 (at least as compared with the profile of the gripping aid 1200 shown in FIG. 12). In some implementations, the more prominent fulcrum point 1402 may enhance the benefit described above of the fulcrum point. For instance, the more prominent crest may increase the rotational speed, torque, and/or strength at which the tool is being swung without requiring the user to adjust the swing speed and/or grip of the tool handle.

FIG. 15 illustrates yet another example profile of an implementations of a gripping aid 1500 with a more pointed fulcrum point 1502. For similar reasons to those mentioned above with regard to FIG. 14, the pointed fulcrum point 1502 may help increase the tool speed as the tool crest or rotates over the fulcrum point 1502. In addition, the pointed fulcrum point 1502 may increase the grip span of the user holding the handle of the tool begin swung. In this instance, the increased grip span may increase the grip strength of the user without requiring the user to alter his/her existing grip.

Figure 16B:
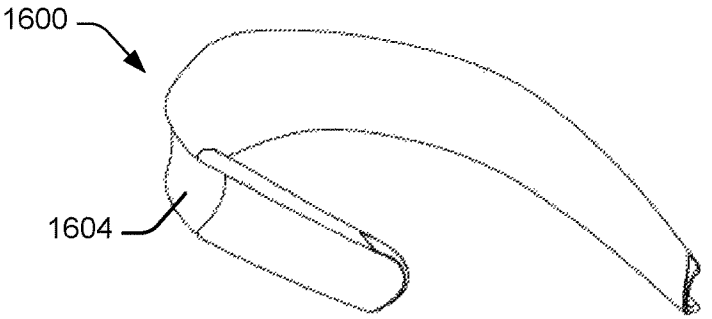
FIGS. 16A-16D are various views of an example gripping aid having a contoured shape and taper with varying widths and thicknesses.
Figure 16D:
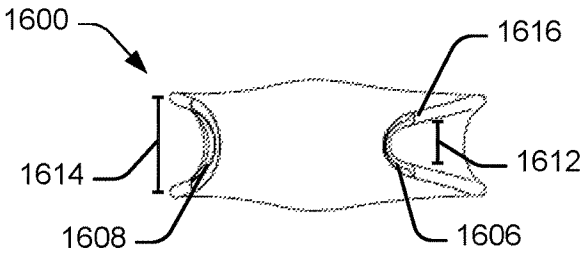
Figure 16A:
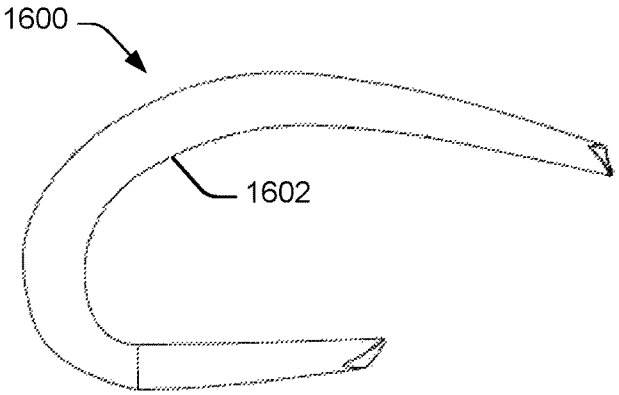

FIGS. 16A-16D illustrate, respectively, a top, a perspective, a left side, and a front view of an example implementation of a gripping aid 1600. FIG. 16A shows the gripping aid 1600 having a pre-molded contour to secure mask the lateral aspect of a user's hand along the thumb webbing between a joint on the index finger and a joint on the thumb. In addition, FIG. 16A shows the fulcrum point 1602 formed by the apex or ridge on the side of the gripping aid 1600 configured to interact with the handle of the tool. In some implementations, the fulcrum point 1602 runs the entire length of the gripping aid 1600. However, in other implementations, the fulcrum point 1602 may be positioned over a portion of the gripping aid 1600. For instance, the fulcrum point 1602 may be disposed over a surface opposite the thumb webbing of the user.

FIG. 16B illustrates a perspective view of the gripping aid 1600 while showing the concave surface 1604 of the gripping aid 1600. As described above, the concave surface 1604 may be configured to contour to a surface of the user's hand (e.g., the lateral aspect of the index finger, thumb webbing, and/or thumb). As shown, the width and depth of the concave surface 1604 may vary based on the size of the surface of the user's hand that is to be contoured. In some implementations, the width and depth of the concave surface 1604 may vary based on a corresponding thickness of the gripping aid 1600. For instance, a thicker portion of a gripping aid may correspond to the concave surface 1604 with a greater depth.

Figure 16C:
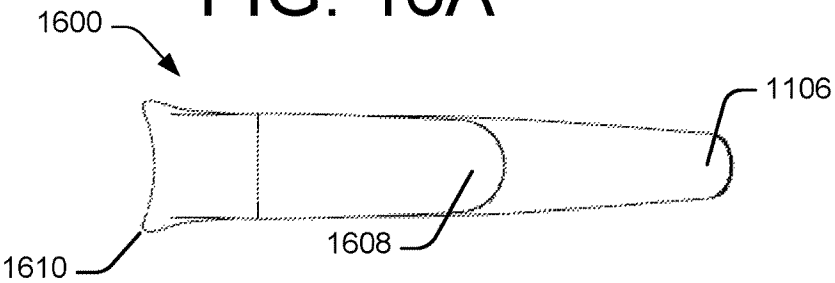

FIG. 16C illustrates the gripping aid 1600 with a variable width. In some implementations, a variable width may increase comfort and/or increase a range of motion of the user's hand as the gripping aid is squeezed. As shown, the gripping aid 1600 has a first width at the first end 1606. The first end 1606 corresponds to a portion of the gripping aid 1600 configured to interact with the index finger of the user which is generally less wide that the thumb of the user. In this implementation, a second end 1608 may include a second width which is wider than the width at the first end 1606. The second end may be configured to contour a portion of the user's thumb. Further, the gripping aid 1600 may include yet another width such as the third width shown at a thumb portion 1610. As shown, the third width at the thumb portion 1610 may be the widest portion of the gripping aid 1600. In some implementations, the width at the thumb portion 1610 may increase the overall stability of the gripping aid 1600 and provide a better base for the gripping aid 1600 to remain securely in place on the user's hand as the user manipulates a handle.

FIG. 16D illustrates a front view of the gripping aid 1600. Generally, the front view shows the variation in the width of the first end 1606 (width 1612) and the second end 1608 (width 1612). FIG. 16D also illustrates a reduction in thickness (i.e., taper 1616) toward the first end 1606 and the second end 1608. In some implementations, the reduction in thickness may increase comfort of the gripping aid 1600. Furthermore, the reduction of thickness at each end may increase the tactile sensation that the user may perceive which may in turn increase an amount of control of the handle that the user perceives. While FIG. 16D illustrates a consistent reduction in thickness at each end 1606 and 1608, respectively, it is understood that each end may taper at a different severity or include no taper at all.

Figure 17:
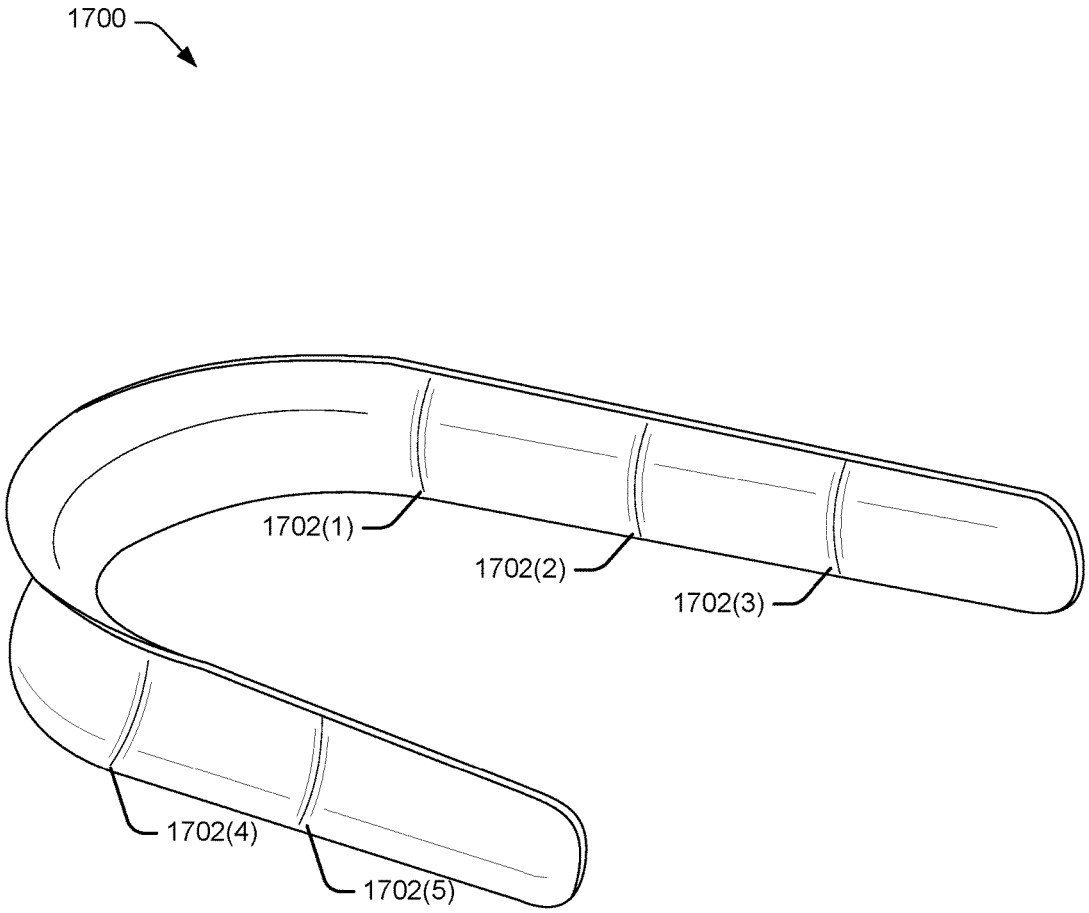
FIG. 17 is a perspective view of another example gripping aid having hinges or joints.

FIG. 17 illustrates an example gripping aid 1700 with multiple hinges or joints 1702(1)-(5). In some implementations, the gripping aid 1700 may include the hinges 1702 (1)-(5) to facilitate the flexible elastomeric plastic in bending. However, the gripping aid 1700 may remain incompressible. As shown, the hinges 1702(1)-(5) may be located on the portions of the gripping aid 1700 opposite the index finger and/or thumb. The hinges 1702(1)-(5) may be living hinges such as scored seams in the gripping aid 1702 that when the gripping aid is bend, the seams provide a bend point on the gripping aid 1700. While FIG. 17 illustrates five hinges, it is understood that more or fewer hinges may be used in other implementations. For example, one hinge or ten hinges. Furthermore, in other implementation, any number of other hinges may be used in place of or in combination with the scored seams described above. For instance, the hinges may be a parametric kerf pattern, a partially scored seam, a living hinge, a lattice hinge, a zipper joint, and/or a rib joint.

Figure 18:
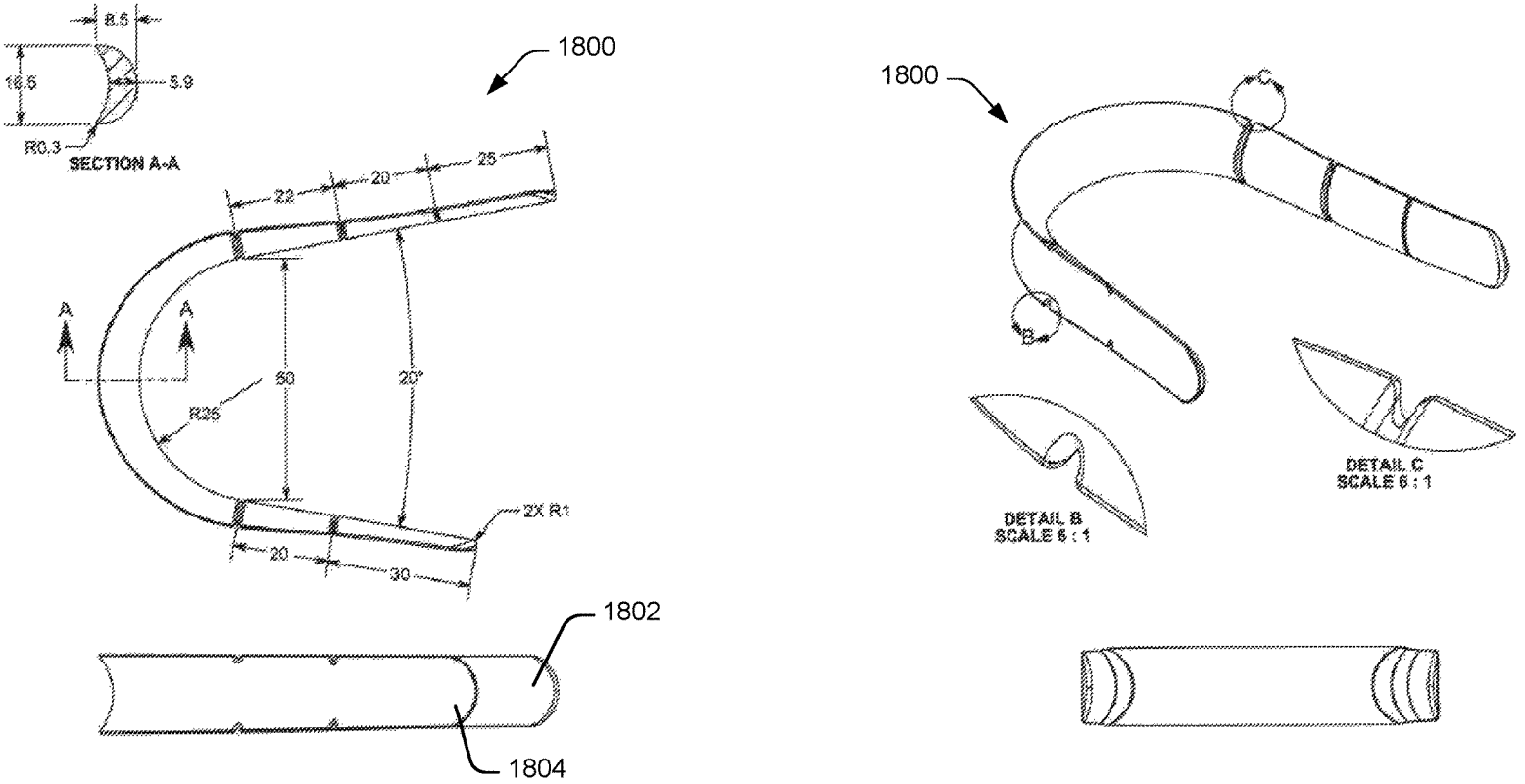
FIG. 18 include various views of yet another example gripping aid having a uniform width and hinge notches.

FIG. 18 illustrates various views of an example gripping aid 1800 which may be used with a glove to provide the benefits described above. As shown, the gripping aid 1800 has a uniform width from a first end 1802 to a second end 1804. Furthermore, the views of FIG. 18 illustrate various example dimensions of the gripping aid 1800. For instance, the gripping aid shown the index finger portion having three areas separated by a score line. Each portion having a different length. For instance, the end portion having a length of 25 millimeters, the middle portion having a length of 20 millimeters, and the inner portion having a length of 22 millimeters.

Gripping aid 1800 may also include one or more hinges or joints as described above. However, as shown in FIG. 18, gripping aid 1800 may include a score line on the inner surface of the aid while the top surface and bottom surface may include a notch at the score line. The score line and corresponding notch may improve the flexibility of the gripping aid in the designated locations. Furthermore, such a hinge may restrict unwanted flexibility of the gripping aid in the opposite direction. Finally, the hinge may allow the gripping aid to withstand a greater amount of torque without tearing or otherwise breaking.

In some implementations, the lines on the gripping aid 1800 may be formed to be gaps in the gripping aid. The gaps may be configured to be located over the joints of the user's digits. In other implementations, the gaps may be configured to be a specific width such that it coordinates with a specific location of a user's index finger. For instance, the gap may be located along the gripping aid such that a portion of the gripped tool fits within the gap.

CONCLUSION

Although the disclosure describes embodiments having specific structural features and/or methodological acts, it is to be understood that the claims are not necessarily limited to the specific features or acts described. Rather, the specific features and acts are merely illustrative some embodiments that fall within the scope of the claims of the disclosure.

What is claimed is:

1. A gripping aid comprising:

a shaped support positioned on a human hand to substantially span a location from a first portion of a first digit of the human hand to a second portion of a second digit of the human hand, the shaped support having at least one fulcrum point substantially spanning a length on an outer surface of the gripping aid facing away from the human hand and toward a handle held by the human hand, the fulcrum point provides a location for rotation for the handle as it is manipulated by the human hand.

2. The gripping aid as recited in claim 1, wherein the shaped support increases a grip span of the human hand by filling in one or more soft tissue gaps created by one or more joints of the first digit and second digit of the human hand.

3. The gripping aid as recited in claim 1, wherein the gripping aid covers a thumb webbing of the human hand and the fulcrum point facing toward the handle is offset by about 30 degrees toward a lateral surface of the human hand.

4. The gripping aid as recited in claim 1, wherein the location of rotation provided by the fulcrum point facing toward the handle is between the gripping aid and the handle to speed the centripetal force of a distal end of the handle as the human hand manipulates a proximal end of the handle.

5. The gripping aid as recited in claim 1, wherein the gripping aid comprises an incompressible material to create a structure in the soft tissue area of a thumb webbing of the human hand to oppose a force exerted by the first digit and the second digit of the human hand as each grips the handle.

6. The gripping aid as recited in claim 1, where the fulcrum point is created by a variable radius curvature across the width of the shaped support from a palmar side of the human hand to a dorsal side of the human hand.

7. The gripping aid as recited in claim 1, wherein the first portion of the first digit is an interphalangeal joint of a thumb and the second portion of the second digit is a distal interphalangeal of an index finger.

8. The gripping aid as recited in claim 1, wherein the first portion of the first digit is substantially a tip of a thumb and the second portion of the second digit is substantially a tip of an index finger.

9. The gripping aid as recited in claim 1, wherein the gripping aid further comprises a non-slip texture to create friction as the human hand manipulates the handle.

10. A gripping aid for a human hand comprising:

a fulcrum point facing away from the human hand and toward a handle held by the human hand, the fulcrum point configured to:

cover at least a portion of a thumb webbing of the human hand;

increase a grip span of the human hand by filling in the soft tissue gaps created by the joints of one or more digits of the human hand; and provide a location for rotation for the handle as it is manipulated by the human hand.

11. The gripping aid as recited in claim 10, wherein the gripping aid comprises an incompressible material to create a structure in the soft tissue area of a thumb webbing of the human hand to oppose a force exerted by at least one digit of the human hand as it grips the handle.

12. The gripping aid as recited in claim 10, wherein the gripping aid positions the human hand relative to the handle such that the handle is slanted way from a palm of the human hand.

13. The gripping aid as recited in claim 10, where the fulcrum point comprises a variable radius curve that covers the width of the gripping aid from a palmar side of the human hand to a dorsal side of the human hand.

14. The gripping aid as recited in claim 10, wherein the gripping aid and the fulcrum point are further configured to cover at least a portion of an index finger and at least a portion of a thumb of the human hand.

15. An incompressible gripping aid comprising:

a first portion disposed on a portion of an index finger of a human hand;

a second portion disposed on a portion of a thumb of the human hand; and a third portion disposed over a thumb webbing between the portion of the index finger and the portion of the thumb, wherein the gripping aid includes a variable radius curvature creating a fulcrum point facing away from at least the third portion and toward a handle held in the human hand.

16. The gripping aid as recited in claim 15, wherein the gripping aid further comprises at least one of:

a fourth portion disposed on a portion of a middle finger of a human hand;

a fifth portion disposed on a portion of a ring finger of a human hand; and a sixth disposed on a portion of a little finger of a human hand.

17. The gripping aid as recited in claim 15, wherein the gripping aid is integrated with a glove worn on the human hand.

18. The gripping aid as recited in claim 15, wherein the first portion, the second portion, and the third portion are molded into a single gripping aid.

19. The gripping aid as recited in claim 15, wherein an inner surface of at least the third portion of the gripping aid includes a concave surface to contour to the thumb webbing between the portion of the index finger and the portion of the thumb of the human hand.

20. The gripping aid as recited in claim 15, wherein the first portion and the second portion are configured with gradual reduction in thickness as each move away from the third portion.

* * * * *